US005359873A

United States Patent [19]

Grondziel

[11] Patent Number: 5,359,873

[45] Date of Patent: Nov. 1, 1994

[54] FIBER FOR REINFORCING CONCRETE OR SIMILAR MATERIALS MADE OF WIRE OF A FLAT MATERIAL STRIP AND DEVICE FOR MANUFACTURING SUCH FIBERS

[75] Inventor: Marian Grondziel, Herne, Germany

[73] Assignee: Vulkan Harex Stahlfasertechnik GmbH & Co. KG, Herne, Germany

[21] Appl. No.: 106,382

[22] Filed: Aug. 13, 1993

[30] Foreign Application Priority Data

Aug. 13, 1992 [DE] Germany ..... 4226744

[51] Int. Cl.[5] ..... B21H 8/02

[52] U.S. Cl. ..... 72/186

[58] Field of Search ..... 72/185, 186, 196

[56] References Cited

U.S. PATENT DOCUMENTS

| | | | |
|---|---|---|---|
| 99,221 | 1/1870 | Montgomery | 72/186 |
| 1,365,258 | 1/1921 | Lundin | 72/196 |
| 3,942,955 | 3/1976 | Moens . | |
| 4,210,009 | 7/1980 | Farfor et al. | 72/186 |
| 4,608,845 | 9/1986 | Campbell | 72/196 |

FOREIGN PATENT DOCUMENTS 0475917 3/1992 European Pat. Off. .

1446855 8/1976 United Kingdom .

OTHER PUBLICATIONS

Dipl.-Ing. Marian Grondziel et al; Development of steel . . . ; Published Jun. 1990; pp. 1-15.

*Primary Examiner*—Lowell A. Larson

*Attorney, Agent, or Firm*—Robert W. Becker & Associates

[57] ABSTRACT

A fiber for reinforcing concrete is manufactured from wire or flat bands and has a linear center section and a first intermediate section connected to the first end of the center section and a second intermediate section connected to the second end of the center section. The first and the second intermediate sections have a wavy shape and are shorter than the center section. A first end section is connected to the first intermediate section and a second end section is connected to the second intermediate section. The first and the second intermediate sections preferably have an elongated S-shaped deformation extending in a common plane. The first and the second end sections are substantially linear and extend parallel displaced to the center section. The fibers are produced in one stamping operation in an inexpensive manner.

4 Claims, 2 Drawing Sheets

FIBER FOR REINFORCING CONCRETE OR SIMILAR MATERIALS MADE OF WIRE OF A FLAT MATERIAL STRIP AND DEVICE FOR MANUFACTURING SUCH FIBERS

BACKGROUND OF THE INVENTION

The present invention relates to a fiber, for reinforcing concrete or similar materials, made of wire or flat strip material, especially made from steel, whereby the fibers have a substantially linear center section and hook-shaped bent end sections.

Fibers of the aforementioned kind for intermixing with initially soft, curable material such as concrete are known in various embodiments. In most cases such fibers are comprised of a substantially linear piece of wire with hook-shaped deformations on both ends, whereby the ends can be angularly or circularly deformed or in the form of a closed circle. A primary requirement for such fibers is that their deformation does not impart a disadvantageous effect on their miscibility, that, on the other hand, a good binding characteristic within the hardened material can be achieved, and that they are producible in an inexpensive manner. The substantial fulfillment of one of these requirements, such as the improvement of its binding qualities, may result in the miscibility properties as well as the manufacturing cost being disfavorably affected.

It is therefore an object of the present invention to provide an improved fiber of the aforementioned kind with respect to substantially fulfilling the aforementioned three basic requirements. A further object of the present invention is to provide a suitable device for manufacturing such fibers.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
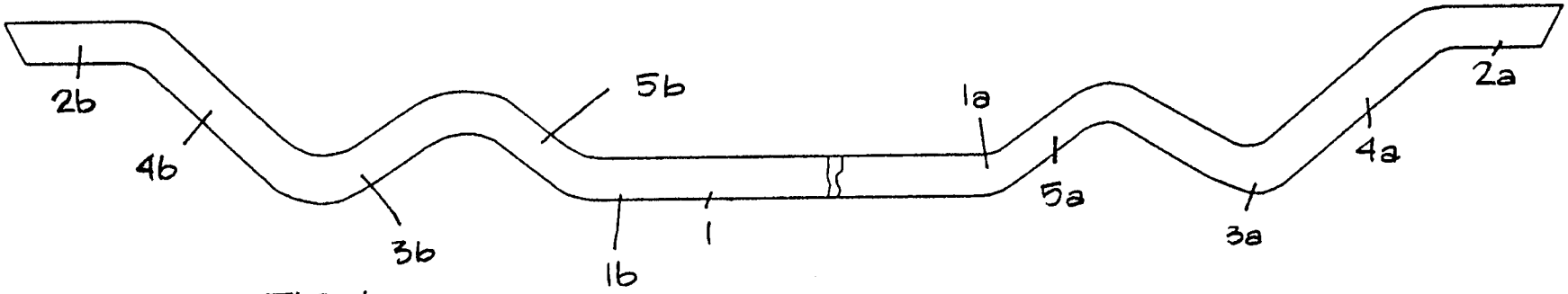
FIG. 1 shows a side view of a fiber made from wire, whereby the plane of the deformation corresponds to the paper plane.

The inventive fiber, manufactured from a wire or a flat band, for reinforcing concrete according to the present invention is primarily characterized by:

A linear center section with a first and a second end;

A first intermediate section connected to the first end and a second intermediate section connected to the second end, the first and the second intermediate sections having a wavy shape and being shorter than the center section; and A first end section connection to the first intermediate section and a second end section connected to the second intermediate section.

Preferably, the first and the second intermediate sections have an elongated S-shape.

Advantageously, the wavy shapes of the first and the second intermediate sections extend in a common plane.

Expediently, the first and the second end sections are substantially linear and extend substantially parallel displaced to the center section.

Advantageously, the first and the second end sections each have a wedge-shaped free end portion produced by stamping, the wedge-shaped end portion widening in an outward direction to become wider than the first and the second end sections.

Accordingly, in a first preferred embodiment the wavy intermediate sections are in the form of an elongated S-shaped portion. In order to simplify the manufacture of the deformations, respectively, S-shaped intermediate sections, it is preferred that the wavy shapes extend in the same plane. The end sections are preferably linear and extend parallel to the center section, but displaced relative to the center section.

In another preferred embodiment of the present invention, the end sections at their free ends are provided with a wedge-shaped form produced by compression or stamping. The outermost free end of the wedge-shaped end portion is wider than the profile of the fiber.

An important advantage of the inventive fiber is that the intermediate sections connected to the linear center section are provided with smooth deformations that have no sharp transitions so that the miscibility of the fibers is favorably affected. Furthermore, all deformations are designed such that the fibers can be produced as a finished product in one single operating step. This results in a substantial reduction of manufacturing costs.

The device for manufacturing the above-described fibers according to the present invention is primarily characterized by:

Two oppositely and synchronously rotating stamping rollers each having an outer circumferential surface, the stamping rollers positioned relative to one another such that the outer circumferential surface of a first one of the stamping rollers is spaced at a distance from the outer circumferential surface of the second roller, the distance corresponding to a thickness of the fiber;

Each outer circumferential surface having projections and depressions, with the projections of the first stamping roller engaging depressions of the second stamping roller and with depressions of the first stamping roller engaging projections of the second stamping roller;

The first stamping roller comprising stamping elements connected within the outer circumferential surface and distributed in a circumferential direction of the first stamping roller with an identical angular displacement relative to one another, the stamping elements extending radially and having, viewed in a plane of rotation, a triangularly shaped free end projecting past the outer circumferential surface; and The second stamping roller comprising stamping abutments connected within the outer circumferential surface and distributed in a circumferential direction of the second stamping roller with the aforementioned identical angular displacement relative to one another so as to correspond to the stamping elements, the stamping abutments extending radially and having, viewed in a plane of rotation, a planar free end flush with the outer circumferential surface, with the circumferential length of the angular displacement at the first and the second stamping rollers corresponding to a length of the fiber.

Preferably, each stamping element and a corresponding one of the stamping abutments are radially adjusted such that, when positioned opposed to one another, the stamping element and the corresponding stamping abutment are contacting one another without exerting pressure on one another.

Advantageously, the projections and the depressions of the first and the second outer circumferential surfaces are contoured such that the fiber is manufactured in the desired shape in one stamping operation.

Expediently, the stamping elements and the stamping abutments are detachably connected within the outer circumferential surfaces of the first and the second stamping rollers. Accordingly, the stamping elements and the stamping abutments at the stamping rollers are interchangeable with other types of stamping elements and stamping abutments.

The starting material for manufacturing the inventive fibers of the aforementioned kind is in the form of wire or a flat band which is supplied as endless material to the two stamping rollers. The endless material is pulled through the gap between the outer circumferential surfaces of the two stamping rollers in the fashion of a double roller due to the oppositely and synchronously rotating stamping rollers. Due to the tooth-like projections and depressions within the outer circumferential surfaces the flat band or wire is deformed in the desired manner, whereby furthermore due to the stamping element and the corresponding stamping abutment a compression and separation operation is also performed, so that the finished fibers are separated from the endless starting material.

During this separation operation, on the one hand, a wedge-shaped flattening in the direction toward the end face occurs at the outer end of two oppositely arranged end sections being formed and, on the other hand, a widening of the end section takes place by material displacement resulting in a dove-tail profile. Due to this wider end portion of the end section an additional improvement of the adhesion of the fibers within the material to be hardened is achieved.

When using a flat band as the starting material, the narrower side of the rectangular profile of the starting material is preferably deformed.

DESCRIPTION OF PREFERRED EMBODIMENTS

The present invention will now be described in detail with the aid of several specific embodiments utilizing FIGS. 1 through 3.

FIG. 1 shows the finished fiber in an enlarged representation. The actual size of such a fiber is approximately 6 cm whereby greater lengths are also possible.

The fiber is comprised of a linear center section 1 and shorter, also substantially linear, end sections 2 which extend substantially parallel to the center section 1. On both ends of the center section 1 a wavy, respectively, bent intermediate section 3 is provided as a transition to the respective end sections 2. In the represented embodiment the intermediate section 3 has an elongated S-shape with a peak and a valley whereby the leg 4 adjacent to the end section 2 is longer than the leg 5 adjacent to the center section 1. The respectively selected length of the leg 4 determines the magnitude of the parallel displacement of the end sections 2 relative to the center section 1. All bending locations of the deformation of the fiber are softly curved in order to avoid sharp (angular) bents.

Figure 2:
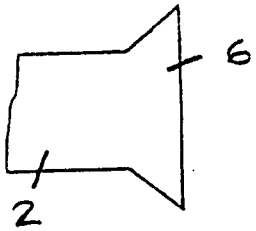
FIG. 2 shows an enlarged side view of a free end of the fiber in a view rotated about 90° relative to the representation of FIG. 1.

The outer most ends of both end sections 2 have a dove tail profile 6, as shown in FIG. 2. The dove tail end portion is wedge-shaped and flattened towards the free end. This shape results from the manufacture of the fibers which will be explained in the following in detail.

The length ratios of the individual sections of the fiber and the angles of the bent portions may vary. Preferably, the length of the intermediate sections 3 is 30% or less of the length of the center section 1. The end sections 2 are commonly shorter than the intermediate sections. The deformations are preferably in one common plane. When using round wire as the starting material, the diameter can be for example 0.4 to 1.0 mm.

Figure 3:
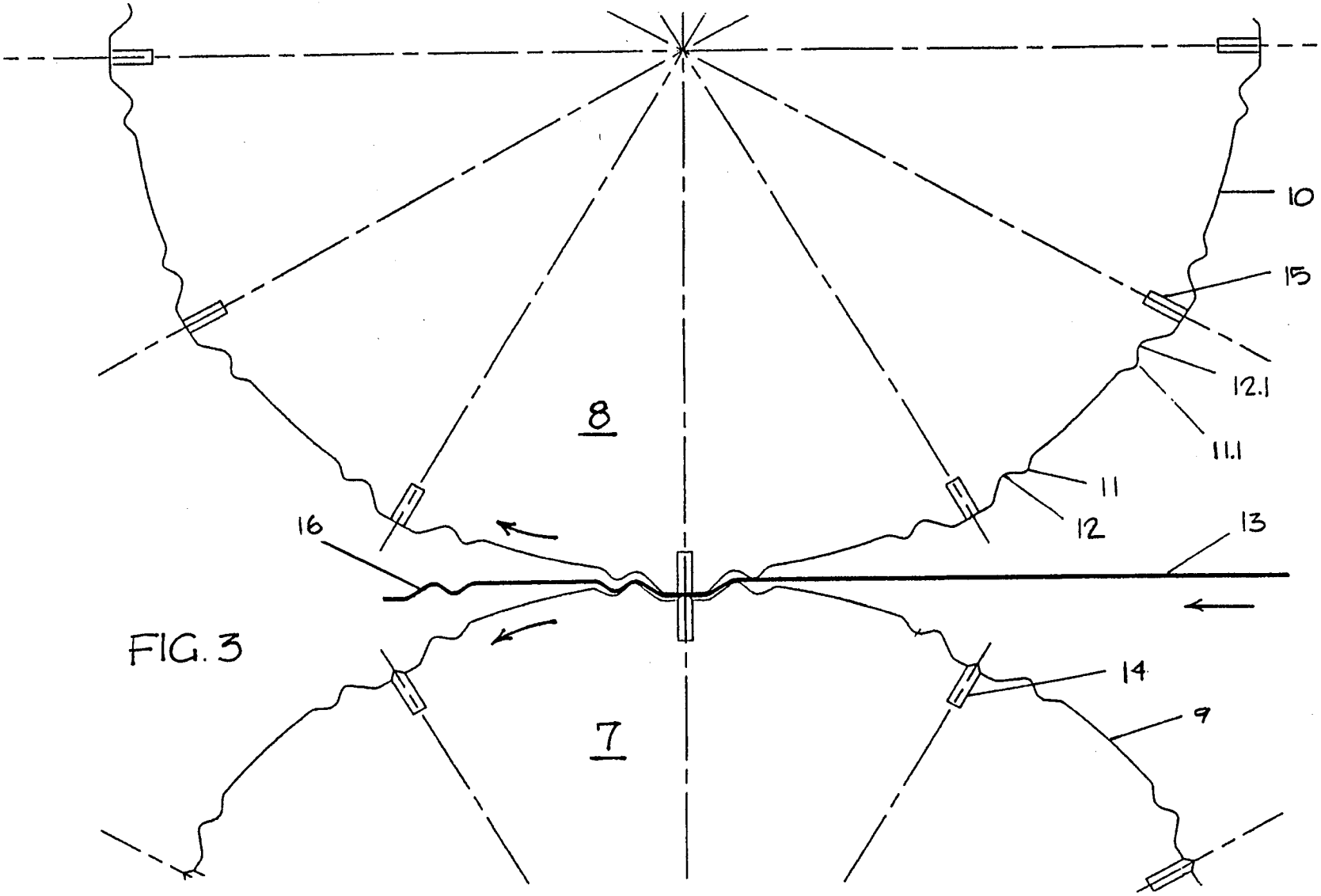
FIG. 3 is a side view of a portion of two stamping rollers, for manufacturing the inventive fibers, with their outer circumferential surfaces opposed to one another.

For the manufacture of fibers according to FIGS. 1 and 2 a device is being used that comprises, among other elements, two stamping rollers 7, 8, shown schematically in FIG. 3.

The two stamping rollers 7, 8 are opposed to one another in the manner of two spur gears whereby between their outer circumferential surfaces a gap corresponding to the thickness of the starting material to be worked is provided. The outer circumferential surfaces 9, 10 are provided with sequentially arranged projections 11 and depressions 12 that correspond to the desired deformation of the intermediate section of the finished fiber. Depending on the desired length of a finished fiber the entire circumference of the stamping rollers is provided with projections 11 and depressions 12 that are uniformly distributed. Two sequentially arranged pairs of projections and depressions 11, 12; 11.1, 12.1 effect the desired deformation of a single fiber. The non-deformed portions of the outer circumferential surface correspond to the center section 1, respectively, to the end sections 2 of a fiber.

For separating the finished, deformed fiber from the starting material 13, the stamping roller 7 is provided with stamping elements 14 having a triangular profile within the rotation plane and distributed with a uniform angular spacing or displacement relative to one another. The stamping roller 8 is provided with stamping abutments 15 having a planar (flat) free end and spaced circumferentially with the same displacement. The stamping elements 14 and the stamping abutments 15 extend radially within the stamping rollers. The stamping elements 14 and the stamping abutments 15 are adjusted in their radial position such that, when they are oppositely arranged to one another in a common radial plane, they contact each other but do not exert any pressure onto one another.

The representation according to FIG. 3 shows a position of the stamping rollers 7, 8 in which a finished fiber 16 has been separated from the starting material 13 fed between the rollers. No further finishing steps are needed. Due to the inventive separation of the fibers a considerable increase of productivity is achieved in comparison to known methods.

The starting material may be in the form of wire, preferably round wire, or flat bands.

The present invention is, of course, in no way restricted to the specific disclosure of the specification and drawings, but also encompasses any modifications within the scope of the appended claims.

What I claim is:

1. A device for manufacturing a fiber for reinforcing concrete from a material in a form selected from the group consisting of wire and a flat band, the fiber having: a linear center section with a first and a second end; a first intermediate section connected to said first end and a second intermediate section connected to said second end, said first and said second intermediate sections having a wavy shape and being shorter than said center section; and a first end section connected to said first intermediate section and a second end section connected to said second intermediate section, said device comprising:

two oppositely and synchronously rotating stamping rollers each having an outer circumferential surface, said stamping rollers positioned relative to one another such that said outer circumferential surface of a first one of said stamping rollers is spaced at a distance from said outer circumferential surface of said second roller, said distance corresponding to a thickness of the fiber;

each said outer circumferential surface having projections and depressions, with said projections of said first stamping roller engaging depressions of said second stamping roller and with depressions of said first stamping roller engaging projections of said second stamping roller;

said first stamping roller comprising stamping elements connected within said outer circumferential surface and distributed in a circumferential direction of said first stamping roller with an identical angular displacement relative to one another, said stamping elements extending radially and having, viewed in a plane of rotation, a triangularly shaped free end projecting past said outer circumferential surface; and said second stamping roller comprising separate individual stamping abutments connected within said outer circumferential surface and distributed in a circumferential direction of said second stamping roller with said identical angular displacement relative to one another so as to correspond to said stamping elements, said stamping abutments extending radially and having, viewed in a plane of rotation, a planar free end flush with said outer circumferential surface, with a circumferential length of said angular displacement at said first and said second stamping rollers corresponding to a length of the fiber.

2. A device according to claim 1, wherein each said stamping element and a corresponding one of said stamping abutments are radially adjusted such that, when positioned opposed to one another, each said stamping element and each said corresponding stamping abutment are contacting one another without exerting pressure on one another.

3. A device according to claim 1, wherein said projections and said depressions of said first and second outer circumferential surfaces are contoured such that the fiber is manufactured in the desired shape in one stamping operation.

4. A device according to claim 1, wherein said stamping elements and said stamping abutments are detachably connected within said outer circumferential surfaces of said first and said second stamping rollers.

* * * * *